United States Patent [19]

Karakama et al.

[11] Patent Number: 5,056,415

[45] Date of Patent: Oct. 15, 1991

[54] PILOT OPERATED CONTROL VALVE SYSTEM PERFORMING A SUPPORT FUNCTION

[75] Inventors: Tadao Karakama; Naoki Ishizaki; Yosuke Oda, all of Kanagawa, Japan

[73] Assignee: Kabushiki Kaisha Komatsu Seisakusho, Tokyo, Japan

[21] Appl. No.: 425,163

[22] PCT Filed: Feb. 28, 1989

[86] PCT No.: PCT/JP89/00206

§ 371 Date: Oct. 17, 1989

§ 102(e) Date: Oct. 17, 1989

[87] PCT Pub. No.: WO89/08199

PCT Pub. Date: Sep. 8, 1989

[30] Foreign Application Priority Data

Feb. 29, 1988 [JP] Japan ..... 63-44105

[51] Int. Cl.[5] ..... F15B 11/08

[52] U.S. Cl. ..... 91/454; 91/461; 91/462

[58] Field of Search ..... 91/454, 461, 462; 137/596.14, 596.15, 596.16; 251/25

[56] References Cited

U.S. PATENT DOCUMENTS

| | | | |
|---|---|---|---|
| 3,838,710 | 10/1974 | Reip | 91/454 X |
| 4,480,527 | 11/1984 | Lonnemo | 137/596.15 X |
| 4,611,528 | 9/1986 | Nanda et al. | 137/596.15 X |
| 4,646,622 | 3/1987 | Ishizaki et al. | 91/454 X |
| 4,753,157 | 6/1988 | Lonnemo et al. | 91/462 X |
| 4,794,951 | 1/1989 | Ryzner | 91/454 X |
| 4,955,283 | 9/1990 | Hibaka et al. | 91/461 X |
| 4,984,427 | 1/1991 | Kubomoto | 91/461 X |

FOREIGN PATENT DOCUMENTS

| | | | |
|---|---|---|---|
| 2431804 | 3/1975 | Fed. Rep. of Germany | 91/461 |
| 2343183 | 9/1977 | France | 91/454 |
| 54-19217 | 2/1979 | Japan . | |
| 62-13802 | 1/1987 | Japan . | |
| 62-13803 | 1/1987 | Japan . | |

*Primary Examiner*—Edward K. Look
*Assistant Examiner*—Todd Mattingly
*Attorney, Agent, or Firm*—Ronald P. Kananen

[57] ABSTRACT

In a pilot operated control valve system provided with a plurality of valves for controlling a plurality of hydraulic devices such as hydraulic cylinders, there is employed a plurality of valves each of which does not interfere with each other in operation and requires a minimum mounting space in the system to enable the system to be a small system having a construction easily adapted to control a plurality of hydraulic devices and also adapted to simultaneously supply the pressure oil to the hydraulic devices from a pair of hydraulic pumps through the same hydraulic circuit as needs require.

4 Claims, 8 Drawing Sheets

PILOT OPERATED CONTROL VALVE SYSTEM PERFORMING A SUPPORT FUNCTION

FIELD OF THE INVENTION

The present invention relates to a control valve system for supplying a pressure oil to hydraulic devices such as hydraulic cylinders, hydraulic motors and the like to control that hydraulic equipments in operation, and, more particularly, to a pilot operated control valve system for conducting the directional controls of a plurality of valves of the system by means of pilot pressure oil and for performing a so-called support function in which a pair of hydraulic motors simultaneously supply the pressure oil to the valves of the system through the same hydraulic circuit.

DESCRIPTION OF THE PRIOR ART

Hitherto, it is known that, for example, as shown in FIG. 1, in a control valve system of this kind: a pressure oil discharged from a hydraulic pump 1 is supplied to a first chamber $3_1$ and a second chamber $3_2$ of a hydraulic device 3 through a first meter-in valve $2_1$ and a second meter-in valve $2_2$, respectively. The meter-in valves $2_1$, $2_2$ being two-way valves; the pressure oil having entered the first chamber $3_1$ and the second chamber $3_2$ is discharged into a tank 5 through a first meter-out valve $4_1$ and a second meter-out valve $4_2$, respectively, the meter-out valves $4_1$, $4_2$ being two-way valves. In case that both the first meter-in valve $2_1$ and the second meter-out valve $4_2$ are opened, the pressure oil is supplied to the first chamber $3_1$ of the hydraulic equipment 3, while the pressure oil having entered the second chamber $3_2$ of the equipment 3 is discharged from the second chamber $3_2$ of the equipment 3 into the tank 5. In case that both the second meter-in valve $2_2$ and the first meter-out valve $4_1$ are opened, the pressure oil is supplied to the second chamber $3_2$ of the hydraulic equipment 3, while the pressure oil having entered the first chamber $3_1$ of the hydraulic equipment 3 is discharged therefrom into the tank 5.

In addition, a pilot operated control valve system is known, in which each of the valves described above is constructed of a pilot operated valve and further comprises a first and a second pilot valve, which first pilot valve conducts directional controls of the first meter-in valve $2_1$ and the second meter-out valve $4_2$, and which second pilot valve conducts directional controls of the second meter-out valve $2_2$ and the first meter-out valve $4_1$.

On the other hand, in a power shovel, there are employed at least six hydraulic devices comprising: a boom derricking cylinder, an arm hydraulic cylinder, a bucket hydraulic cylinder, a swing hydraulic motor, a left-hand traveling hydraulic motor and a right-hand traveling hydraulic motor, to which hydraulic devices the pressure oil is supplied through four valves. As a result, the power shovel requires at least 24 valves and 12 pilot valves in operation.

In addition, in a construction-machine vehicle, such as the power shovel provided with the boom derricking cylinder and the arm hydraulic cylinder, it is often required for an operator of the vehicle to simultaneously operate these two hydraulic cylinders in different kinds of operation. In this case, since it is impossible for a single hydraulic pump to simultaneously supply a sufficient quantity of the pressure oil to these hydraulic cylinders, it is necessary to employ a well-known hydraulic circuit system performing a so-called support function in which at least a pair of hydraulic pumps are employed to simultaneously supply a sufficient amount of the pressure oil to a plurality of hydraulic devices through the same hydraulic circuit.

In instances where the pressure oil is supplied to each of the hydraulic devices of the above well-known hydraulic circuit system through four valves, it is necessary to employ a first and a second hydraulic pump. In addition, it is required for the second hydraulic pump to employ a first and a second auxiliary meter-in valve and a first and a second auxiliary pilot valve. As described above, in instances where the pilot operated control valve system with the support function enabling the pair of the hydraulic pumps to simultaneously supply the pressure oil to the plurality of the hydraulic devices, it is required for a valve housing 6 of the control valve system: to have in the interior thereof eight valves comprising the first meter-in valve $2_1$, the second meter-in valve $2_2$, the first meter-out valve $4_1$, the second meter-out valve $4_2$, the first auxiliary meter-in valve, the second auxiliary meter-in valve, the first pilot valve and the second pilot valve; and to form therein two pump ports $7_1$, $7_2$, two tank ports $8_1$, $8_2$, four additional ports $9_1$, $9_2$, $9_3$, $9_4$, the first and the second pilot valve, and pilot passages communicating with these pilot valves. Consequently, when the above-described pilot operated control valve system is employed in the power shovel, it is required for the valve housing 6 of the control valve system of the power shovel to have: 36 valves, 18 pilot valves, a plurality of the pump port passages, a plurality of the tank port passages, a plurality of additional port passages and pilot passages, which causes the valve housing 6 to be large. In addition, in the valve housing 6 of the pilot operated control valve system, it is very cumbersome to form each of the above port passages.

SUMMARY OF THE INVENTION

In view of such circumstances described above, the present invention was made. Consequently, it is an object of the present invention to provide a small pilot operated control valve system having a so-called support function and requiring a minimum mounting space thereof, in which system a plurality of valves are employed to simultaneously control a plurality of hydraulic device of at least two different kinds, for example, such as the boom derricking cylinder and the arm hydraulic cylinder through the same hydraulic circuit; a required number of each of the above valves is reduced, and there is no fear that the plurality of the valves will interfere with each other in operation.

It is another object of the present invention to provide a small pilot operated control valve system having a so-called support function and requiring a minimum mounting space thereof, in which system a plurality of control valves are employed to control each of a plurality of hydraulic devices and there is no fear that the plurality of control valves will interfere with each other in operation.

According to a first embodiment of the present invention, the above objects of the present invention are accomplished by providing a pilot operated control valve system having a support function, comprising a valve housing which is provided with a predetermined lateral width, a predetermined longitudinal width and a predetermined height, and assumes a substantially rectangular parallelepiped form; a first and a second pump port passage so formed in the valve housing as to have the same height, as to be spaced apart in parallel from each other in the longitudinal width direction of the valve housing and as to horizontally extend in the lateral width direction of the valve housing; a tank port passage so formed in the valve housing as to be disposed in a central position of both the height direction and the longitudinal width direction of the valve housing and to horizontally extend in the lateral width direction of the valve housing; a pilot tank port passage and an auxiliary pilot tank port passage so formed in the valve housing as to vertically sandwich the tank port passage therebetween and to extend in parallel with the tank port passage in the lateral width direction of the valve housing so as to be adjacent to the tank port passage; a first and a second pump port passage so formed in the valve housing as to have the same height, so as to be spaced apart in parallel from each other in the longitudinal width direction of the valve housing and to horizontally extend in the lateral width direction of the valve housing; a first and a second port passage so formed in the valve housing as not to be aligned with each other in both the lateral width direction and the longitudinal width direction of the valve housing, to extend vertically to open into an upper surface of the valve housing and to communicate with at least a pair of hydraulic device, a first meter-in valve so inserted into a first meter-in valve receiving bore as to selectively shut off the first pump port passage from the first port passage in operation, the first meter-in valve receiving bore being formed in an upper portion of the valve housing so as to open into a side surface of the valve housing perpendicular to the longitudinal width direction thereof, to horizontally extend in the longitudinal width direction to penetrate the first pump port passage and to communicate with the first port passage; a first meter-out valve so inserted into a first meter-out valve receiving bore as to selectively shut off the tank port passage from the second port passage, the first meter-out valve receiving bore being formed in a central portion of the valve housing so as to open into the side surface of the valve housing perpendicular to the longitudinal width direction thereof, and to horizontally extend in the longitudinal width direction to sequentially communicate with the second port passage and the tank port passage; a second meter-in valve so inserted into a second meter-in valve receiving bore as to selectively shut off the second pump port passage from the second port passage in operation, the second meter-in valve receiving bore being formed in the upper portion of the valve housing so as to open into the other side surface of the valve housing perpendicular to the longitudinal width direction thereof, to horizontally extend in the longitudinal width direction to penetrate the second pump port passage and to communicate with the second port passage; a second meter-out valve so inserted into a second meter-out valve receiving bore as to selectively shut off the tank port passage from the first port passage, the second meter-out valve receiving bore being formed in a central portion of the valve housing so as to open into the other side surface of the valve housing perpendicular to the longitudinal width direction thereof, and to horizontally extend in the longitudinal width direction to sequentially communicate with the first port passage and the tank port passage; a first pilot valve so inserted into a first pilot valve receiving bore as to supply pilot pressure oil to both of the first meter-in valve and the first meter-out valve, the first pilot valve receiving bore being so formed in the valve housing at the same height as that of the pilot tank port passage to horizontally extend in the longitudinal direction of the valve housing to open into the side surface of the valve housing and to communicate with the pilot tank port passage; a second pilot valve so inserted into a second pilot valve receiving bore of the valve housing as to supply the pilot pressure oil to both the second meter-in valve and the second meter-out valve, the second pilot valve receiving bore being so formed in the valve housing at the same level in height as that of the pilot tank port passage as to open into the other side surface of the valve housing perpendicular to the longitudinal width direction of the valve housing, to horizontally extend in the longitudinal width direction of the valve housing and to communicate with the pilot tank port passage; a first auxiliary meter-in valve so inserted into a first auxiliary meter-in valve receiving bore of the valve housing as to selectively shut off the first port passage from the first auxiliary pump port passage, the first auxiliary meter-in valve receiving bore being formed in a lower portion of the valve housing so as to open into the side surface of the valve housing perpendicular to the longitudinal width direction of the valve housing, to horizontally extend in the longitudinal width direction of the valve housing, to penetrate the first auxiliary pump port passage and to communicate with the first port passage; a second auxiliary meter-in valve so inserted into a second auxiliary meter-in valve receiving bore of the valve housing as to selectively shut off the second port passage from the second auxiliary pump port passage, the second auxiliary meter-in valve receiving bore being formed in a lower portion of the valve housing so as to open into the other side surface of the valve housing perpendicular to the longitudinal width direction of the valve housing, to horizontally extend in the longitudinal width direction of the valve housing, to penetrate the second auxiliary pump port passage and to communicate with the second port passage; a first auxiliary pilot valve so inserted into a first auxiliary pilot valve receiving bore of the valve housing as to supply the pilot pressure oil to the first auxiliary meter-in valve, the first auxiliary pilot valve receiving bore being formed in a lower portion of the valve housing so as to open into the side surface of the valve housing perpendicular to the longitudinal width direction of the valve housing in the vicinity of the first auxiliary meter-in valve receiving bore and to horizontally extend in the longitudinal width direction of the valve housing; and a second auxiliary pilot valve so inserted into a second auxiliary pilot valve receiving bore of the valve housing as to supply the pilot pressure oil to the second auxiliary meter-in valve, the second auxiliary pilot valve receiving bore being formed in an upper portion of the valve housing so as to open into the other side surface of the valve housing perpendicular to the longitudinal width direction of the valve housing in the vicinity of the second auxiliary meter-in valve receiving bore and to horizontally extend in the longitudinal width direction of the valve housing.

According to a second embodiment of the present invention, the above objects of the present invention are accomplished by providing the pilot operated control valve system, having the support function described in the first embodiment of the present invention, wherein the pilot operated control valve system is constructed of a plurality of control valve units for controlling a plurality of hydraulic devices the plurality of the control valve units being connected with each other in the lateral width direction of the valve housing of the control valve system.

The pilot operated control valve system with the support function of the present invention having the above first and the second embodiment has the following advantages:

In the pilot operated control valve system having the support function of the present invention, each of the first meter-in valve, the first meter-out valve, the first pilot valve, the first auxiliary pilot valve, the second meter-in valve, the second meter-out valve, the second pilot valve, the second auxiliary pilot valve and the second auxiliary meter-in valve is so formed in the valve housing of the pilot operated control valve system having the support function as to horizontally extend in the longitudinal width direction of the valve housing to open into one of the opposite side surfaces of the valve housing perpendicular to the longitudinal width direction thereof; and so as not to be aligned with each other in the height direction and the lateral width direction of the valve housing. As a result, it is possible for the pilot operated control valve system, having the support function of the present invention, to mount each of the valves in the valve housing with a minimum mounting space thereof without any interference of the valves with each other.

Consequently, even when a plurality of valves are mounted in the valve housing of the pilot operated control valve system having the support function of the present invention, it is possible for the pilot operated control valve system, having the support function of the present invention, to realize a small valve housing which leads to a small pilot operated control valve system having the support function enabling a pair of the hydraulic pumps to simultaneously supply the pressure oil to each of the hydraulic equipment because each of the plurality of the valves only requires a minimum mounting space in the valve housing.

In addition, in the pilot operated control valve system having the support function of the present invention, since each of the first and the second pump port passage, first and second auxiliary pump port passage, auxiliary pilot tank port passage, tank port passage and the pilot tank port passage is so formed in the valve housing of the control valve system as not to be aligned with each other in either the height direction on the longitudinal width direction of the valve housing and to horizontally extend in the lateral width direction of the valve housing, it is possible to sequentially mount each of the first and the second meter-in, the first and the second meter-out, the first and the second pilot valves, the first and the second auxiliary pilot valves and the first and the second auxiliary meter-in valves in the valve housing so as to be spaced apart from each other in the lateral width direction of the valve housing. As a result, it is not required for the valve housing of the pilot operated control valve system having the support function of the present invention to additionally include any of the first and the second pump port passages, the first and the second auxiliary pump port passages, tank port passage, the pilot tank port passage and the auxiliary pilot tank port passage therein. In other words, it is required for the valve housing of the pilot operated control valve system having the support function of the present invention to include only the required number of each of the first and the second port passages in the valve housing, which reduces machining steps of the valve housing in manufacturing.

The above objects, additional objects, additional embodiments and advantages of the present invention will be clarified to those skilled in the art hereinbelow with reference to the following description and accompanying drawings illustrating preferred embodiments of the present invention according to principles of the present invention.

DESCRIPTION OF THE PREFERRED EMBODIMENTS

Figure 1:
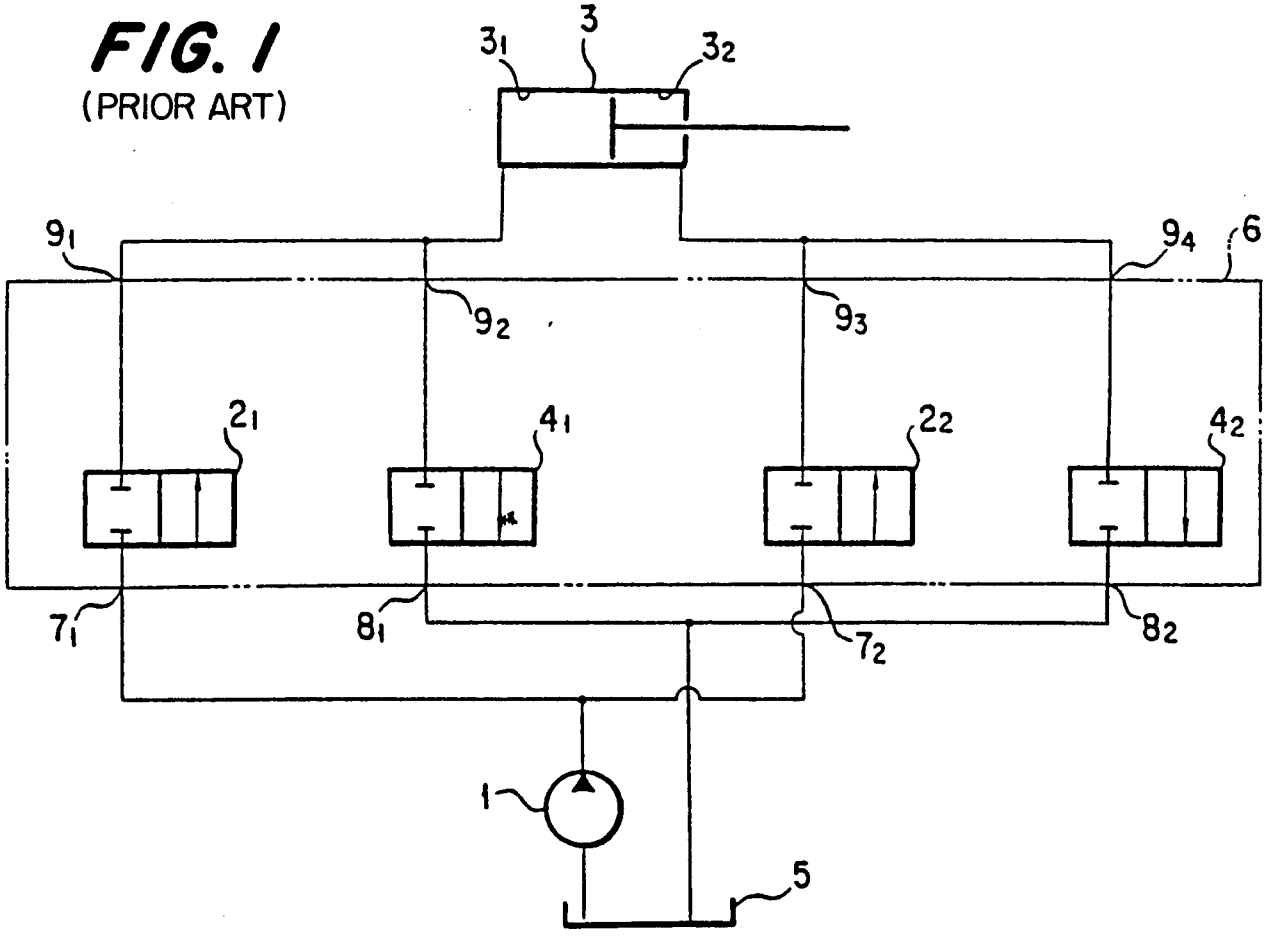
FIG. 1 (PRIOR ART)
FIG. 1 is a schematic hydraulic circuit diagram illustrating an example of a conventional control valve system.

Hereinbelow, an embodiment of the present invention will be described in detail with reference to the accompanying drawings (FIGS. 2 to 10).

As shown in FIGS. 2 to 6, a valve housing 10 of a pilot operated control valve system, having a support function of the present invention, has a predetermined lateral width, a predetermined longitudinal width and a predetermined height, and assumes a rectangular parallelepiped form. In an upper portion of the valve housing 10 of the pilot operated control valve system are formed a first pump port passage 11 and a second pump port passage 12 which communicate with a hydraulic pump (not shown), which are parallel to each other and horizontally extend in the lateral width direction of the valve housing 10 to open into an end surface 10*a* of the valve housing 10, which end surface 10*a* is perpendicular to the lateral width direction of the valve housing 10. In addition, a tank port passage 13 is so formed in the valve housing 10 as to be disposed in a central position of the valve housing 10 in either the height direction or the longitudinal direction thereof, to horizontally extend in the lateral width direction of the valve housing 10 and to communicate with a drain tank (not shown) to open into the end surface 10*a* of the valve housing 10 perpendicular to the lateral width direction of the valve housing 10.

Further, a first port passage 14 and a second port passage 15 are so formed in the valve housing 10 as not to be aligned with each other in both the lateral width direction and the longitudinal width direction of the valve housing 10, to extend vertically to open into an upper surface 10*b* of the valve housing 10 and to communicate with a first pressure chamber $16_1$ and a second pressure chamber $16_2$ of a hydraulic device 16, respectively. In addition, the first port passage 14 and the second port passage 15 are so formed in the valve housing 10 as not to interfere with any of the first pump port passage 11, second pump port passage 12 and the tank port passage 13.

Further, in the valve housing 10, a first meter-in valve receiving bore 17 and a first meter-out valve receiving bore 18 are so formed as to open into a side surface 10*c* of the valve housing 10 perpendicular to the longitudinal width direction of the valve housing 10, not to be aligned with each other in the height direction and the lateral width direction of the valve housing 10, and to horizontally extend in the longitudinal width direction of the valve housing 10. The first meter-in valve receiving bore 17 is so disposed in the upper portion of the valve housing 10 as to penetrate the first pump port passage 11, to communicate with the first port passage 14 and to receive a first meter-in valve 19 therein to selectively shut off the first pump port passage 11 from the first port passage 14. On the other hand, the first meter-out valve receiving bore 18 is so disposed in a central portion of the valve housing 10 in height to open into the tank port passage 13, as to communicate with the second port passage 15, and to receive a first meter-out valve 20 therein to selectively shut off the tank port passage 13 from the second port passage 15.

Furthermore, in the valve housing 10, a second meter-in valve receiving bore 21 and a second meter-out valve receiving bore 22 are so formed as to open into the other side surface 10*d* of the valve housing 10 perpendicular to the longitudinal width direction of the valve housing 10, as not to be aligned with each other in either the height direction on the lateral width direction of the valve housing 10 and to horizontally extend in the longitudinal width direction of the valve housing 10. The second meter-in valve receiving bore 21 is so disposed in the upper portion of the valve housing 10 as to be aligned with the first meter-out valve receiving bore 18 in the lateral width direction of the valve housing 10, to penetrate the second pump port passage 12, to communicate with the second port passage 15, and to receive a second meter-in valve 23 therein to selectively shut off the second pump port passage 12 from the second port passage 15. On the other hand, the second meter-out valve receiving bore 22 is so disposed in a central portion of the valve housing 10 in height as to be aligned with the first meter-in valve receiving bore 17 in the lateral width direction of the valve housing 10, to open into the tank port passage 13, to communicate with the first port passage 14 and to receive a second meter-out valve 24 therein to selectively shut off the tank port passage 13 from the first port passage 14.

Figure 2:
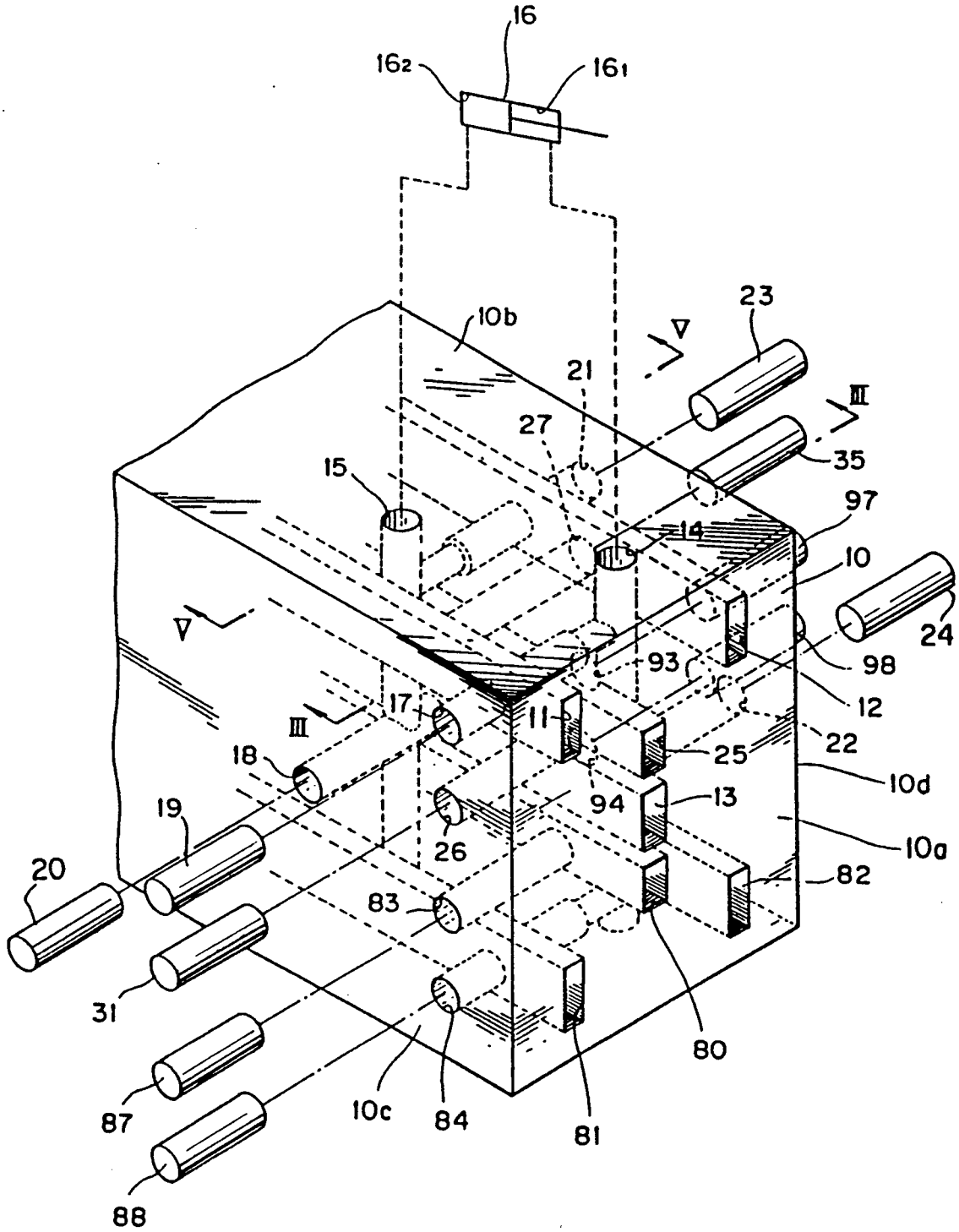
FIG. 2 is a perspective view of a valve housing of a pilot operated control valve system having the support function of an embodiment of the present invention.

Furthermore, as shown in FIG. 2, a first pilot tank port passage 25 and a second, or auxiliary pilot tank port passage 80 are so formed in the valve housing 10 as to vertically sandwich the tank port passage 13 therebetween, to be disposed in a central position of the valve housing 10 in the longitudinal width direction thereof and to extend in parallel with the tank port passage 13 in the lateral width direction of the valve housing 10 so as to be adjacent to the tank port passage 13 and to open into the end surface 10*a* of the valve housing 10.

In addition, in the valve housing 10 are so formed a first auxiliary pump port passage 81 and a second auxiliary pump port passage 82 as to be disposed in the lowest portion of the valve housing 10, to horizontally extend in the lateral width direction of the valve housing 10, to be aligned with the first pump port passage 11 and the second pump port passage 12, respectively in the longitudinal width direction of the valve housing 10 so as to be positioned under the first pump port passage 11 and the second pump port passage 12, respectively, and to communicate with a second hydraulic pump (not shown).

Further, in the valve housing 10 is formed a first pilot valve receiving bore 26 which is so arranged: as to be disposed in a position under the first meter-in valve receiving bore 17; as to be similar to the pilot tank port passage 25 in height and to open into a side surface 10*c* of the valve housing 10, the side surface 10*c* being perpendicular to the longitudinal width direction of the valve housing 10; as to horizontally extend in the longitudinal width direction of the valve housing 10; and as not to be aligned with the second port passage 15 in the lateral width direction of the valve housing 10. In addition, a second pilot valve receiving bore 27 is so formed in the valve housing 10: as to be disposed in a position lower than that of the second meter-in valve receiving bore 21 of the valve housing 10; as to be similar to the pilot tank port passage 25 in height; as to open into the other side surface 10*d* of the valve housing 10; as to horizontally extend in the longitudinal width direction of the valve housing 10; and as not to be aligned with both the second pilot valve receiving bore 27 and the first port passage 14 in the lateral width direction of the valve housing 10.

Figure 3:
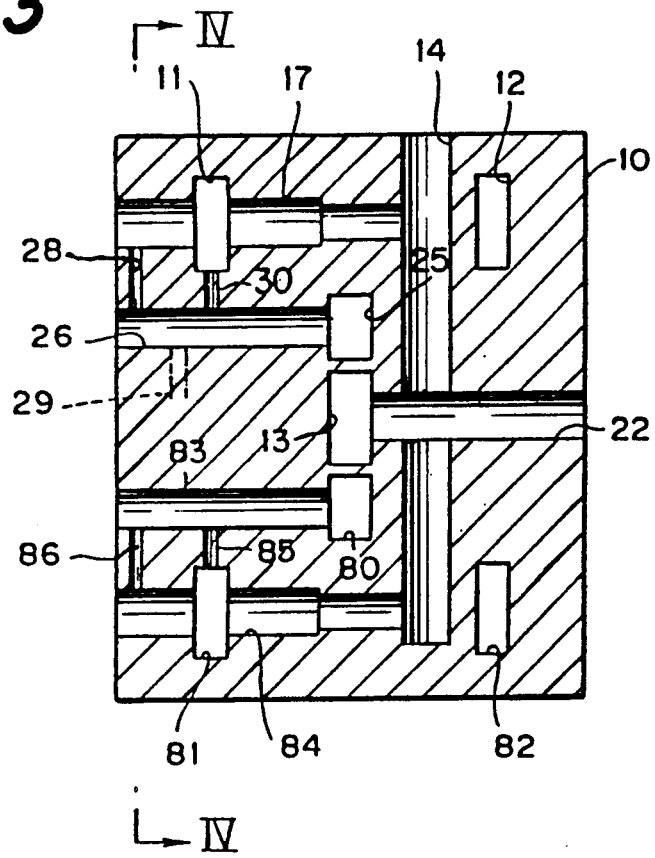
FIG. 3 is a cross-sectional view of the valve housing of the pilot operated control valve system having the support function of the present invention, taken along line III—III of FIG. 2.
Figure 4:
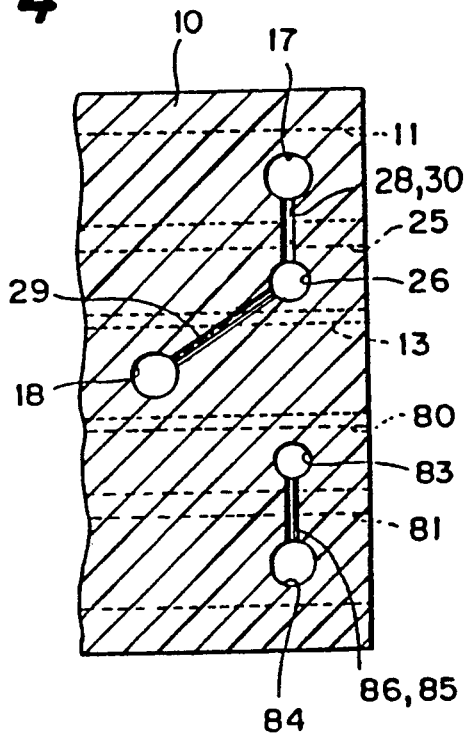
FIG. 4 is a cross-sectional view of a part of the valve housing of the pilot operated control valve system having the support function of the present invention, taken along line IV—IV of FIG. 3.
Figure 5:
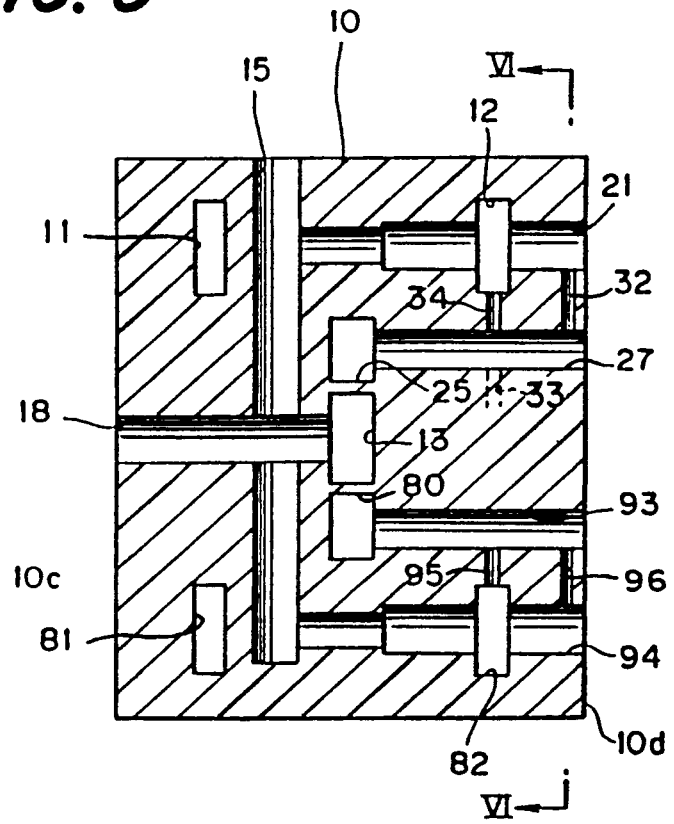
FIG. 5 is a cross-sectional view of the valve housing of the pilot operated control valve system having the support function of the present invention, taken along line V—V of FIG. 2.
Figure 6:
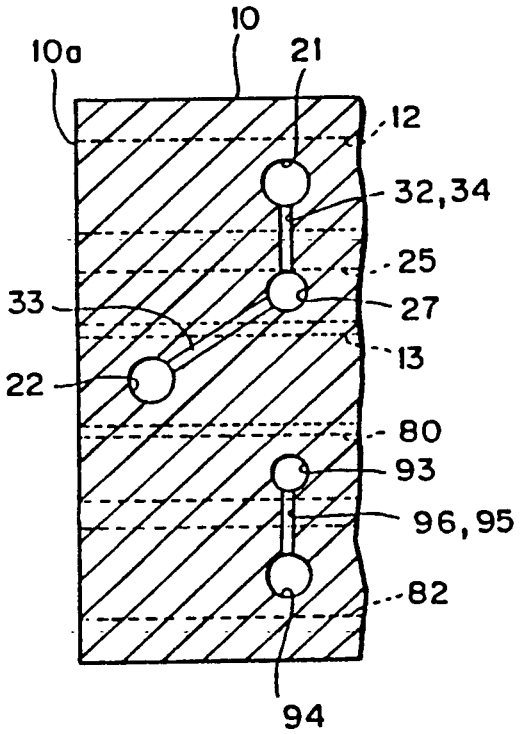
FIG. 6 is a cross-sectional view of the valve housing of the pilot operated control valve system having the support function of the present invention, taken along line VI—VI of FIG. 5.

As shown in FIGS. 3 and 4, the first pilot valve receiving bore 26 communicates with the pilot tank port passage 25 and further communicates with the first meter-in valve receiving bore 17, first meter-out valve receiving bore 18 and the first pump port passage 11 through a first oil hole 28, a second oil hole 29 and a third oil hole 30, respectively. A first pilot valve 31 is inserted into the first pilot valve receiving bore 26 of the valve housing 10 as shown in FIG. 2. On the other hand, as shown in FIGS. 5 and 6, the second pilot valve receiving bore 27 communicates with the pilot tank port passage 25 and further communicates with the second meter-in valve receiving bore 21, second meter-out valve receiving bore 22 and the second pump port passage 12 through a first oil hole 32, a second oil hole 33 and a third oil hole 34, respectively. A second pilot valve 35 is inserted into the second pilot valve receiving bore 27 of the valve housing 10.

As shown in FIG. 2, in the valve housing 10 are so formed a first auxiliary pilot valve receiving bore 83 and a first auxiliary meter-in valve receiving bore 84 as to open into the side surface 10*c* of the valve housing 10, to be disposed in positions under the first pilot valve receiving bore 26, to horizontally extend in the longitudinal width direction of the valve housing 10 and not to be aligned with each other in the height direction of the valve housing 10. As shown in FIG. 3, the first auxiliary pilot valve receiving bore 83 is formed in the valve housing 10 at the same height as the second pilot tank port passage 80 so as to communicate therewith, and further communicate with the first auxiliary pump port passage 81 through a first oil hole 85. On the other hand, as shown in FIG. 3, the first auxiliary meter-in valve receiving bore 84 is formed in the valve housing 10 at the height as the first pump port passage 81 so as to penetrate the first pump port passage 81, to communicate with the first port passage 14, and to communicate with the first auxiliary pilot valve receiving bore 83 through a second oil hole 86. Into the first auxiliary pilot valve receiving bore 83 and the first auxiliary meter-in valve receiving bore 84, a first auxiliary pilot valve 87 and a first auxiliary meter-in valve 88 are inserted, respectively.

As shown in FIG. 2, in the valve housing 10 are so formed a second auxiliary pilot valve receiving bore 93 and a second auxiliary meter-in valve receiving bore 94 as to open into the other side surface 10*d* of the valve housing 10, to be disposed in positions under the second pilot valve receiving bore 27, to horizontally extend in the longitudinal width direction of the valve housing 10 and not to be aligned with each other in the height direction of the valve housing 10. As shown in FIG. 5, the second auxiliary pilot valve receiving bore 93 is formed in the valve housing 10 at the same height as the second pilot tank port passage 80 so as to communicate therewith, and further communicate with the second auxiliary pump port passage 82 through a first oil hole 95. On the other hand, as shown in FIG. 3, the second auxiliary meter-in valve receiving bore 94 is formed in the valve housing 10 at the same height as the second pump port passage 82 so as to penetrate the second pump port passage 82, to communicate with the second port passage 15, and to communicate with the second auxiliary pilot valve receiving bore 93 through a second oil hole 96. Into the second auxiliary pilot valve receiving bore 93 and the second auxiliary meter-in valve receiving bore 94, a second auxiliary pilot valve 97 and a second auxiliary meter-in valve 98 are inserted, respectively.

Figure 7:
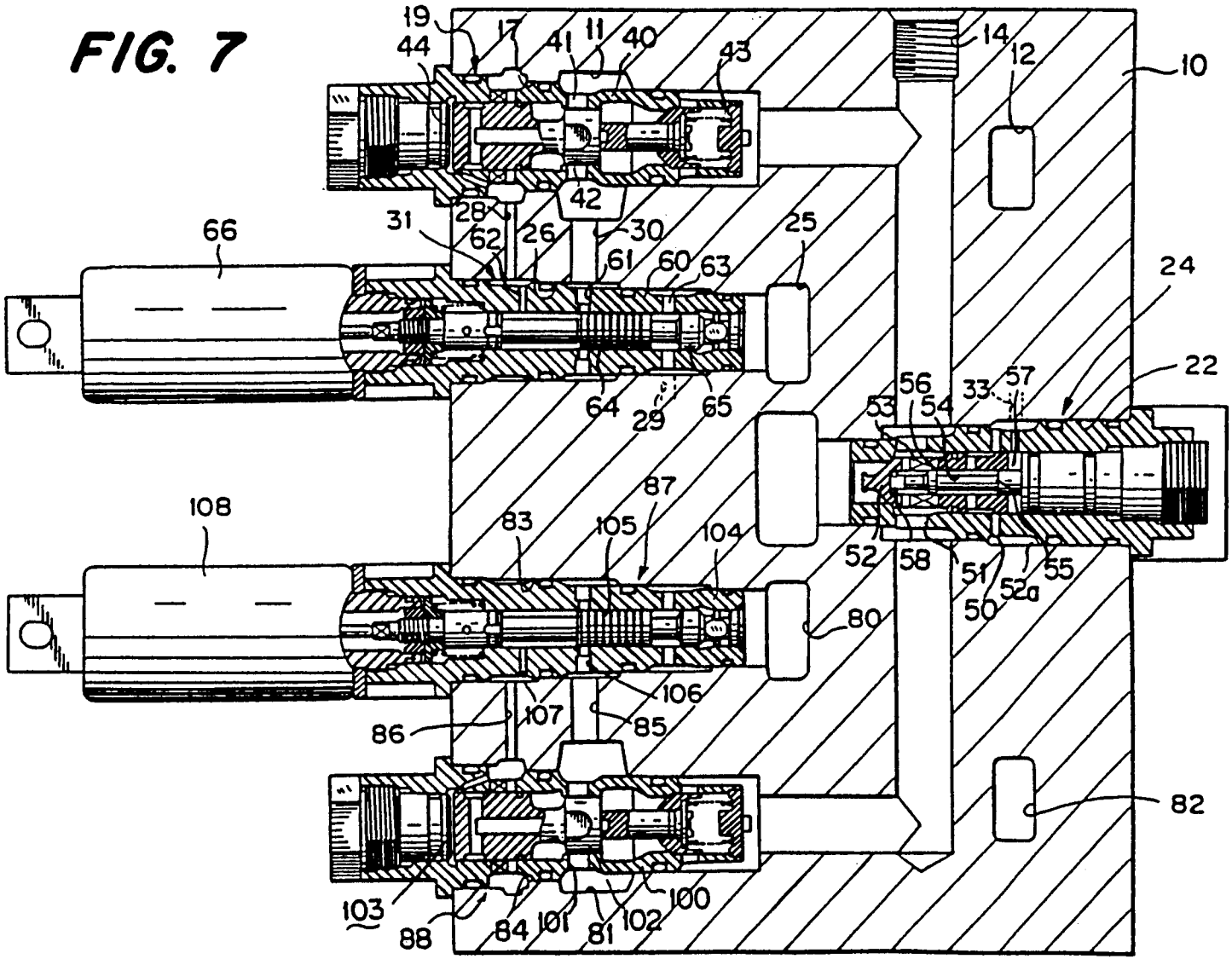
FIGS. 7 and 8 are cross-sectional views of the valve housing of the pilot operated control valve system having the support function of the present invention, illustrating the meter-in valves, the valves and the pilot valves in construction.
Figure 8:
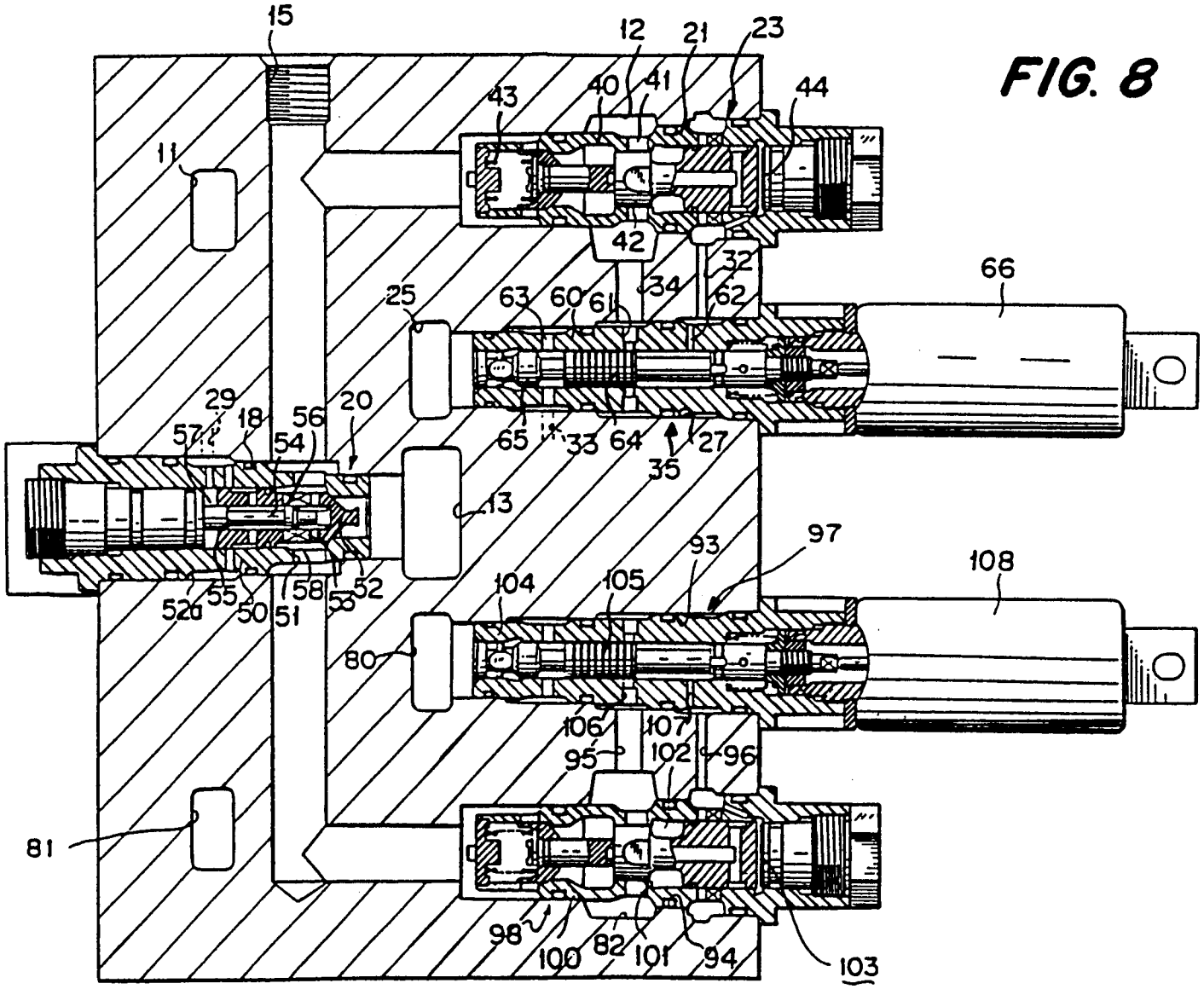

As shown in FIGS. 7 and 8, each of the first meter-in valve 19 and the second meter-in valve 23 is that: an inlet port 41 is formed in a sleeve-like element 40; a spool 42 is inserted into the sleeve-like element 40 to selectively shut off and open the inlet port 41, the spool being so positioned as to normally shut off the inlet port 41 under the influence of a resilient force exerted by a spring 43 and as to open the inlet port 41 when subjected to a predetermined pilot pressure developed in a pressure chamber 44.

As shown in FIGS. 7 and 8, each of the first meter-out valve 20 and the second meter-out valve 24 is constructed so that: an inlet port 51 is formed in a sleeve-like element 50; a poppet 52, to selectively shut off the inlet port 51 from the tank port passage 13, is inserted into the sleeve-like element 50; the inlet port 51 communicates with a back-pressure chamber 57 through a variable aperture 56 which is constructed of a slit groove 53 and a spool 55 inserted into an axial bore 54 of the sleeve-like element 50, to develop a pressure difference across the variable aperture 56; and a spring 58 is interposed between the spool 55 and a bottom portion of the axial bore 54 to normally bring the poppet 52 to its shut-off condition.

As shown in FIGS. 7 and 8, in each sleeve-like elements 60 of the first pilot valve 31 and the second pilot valve 35 are formed an inlet port 61, an outlet port 62 and a drain port 63. A spool 64, for selectively shutting off the inlet port 61 from the outlet port 62, is integrally formed with a poppet 65 for selectively shutting off the drain port 63 from the pilot tank port passage 25, while inserted into the sleeve-like element 60. Each of the spool 64 and the poppet 65 is operated by means of a solenoid 66. The inlet port 61 communicates with the first pump port passage 11 and the second pump port passage 12 through the third oil hole 30 and 34, respectively. On the other hand, the outlet port 62 communicates with the pressure chamber 44 of each of the first meter-in valve 19 and the second meter-in valve 23 through the first oil holes 28 and 32 respectively, while the drain port 63 communicates with the back-pressure chamber 57 of each of the first meter-out valve 20 and the second meter-out valve 24 through the second oil holes 29 and 33.

The pilot operated control valve system having the support function of the present invention has the above construction so that, when the inlet port 61 communicates with the outlet port 62 by displacing the spool 64 and the poppet 65, by means of a solenoid 66, of each of the first pilot valve 31 and the second pilot valve 35, while the drain port 63 communicates with the pilot tank port passage 25, a pressure oil discharged from the tank port passage 13 is supplied to the pressure chamber 44 of the first meter-in valve 19 or the second meter-in valve 23 to move the spool 42 to its communication position. At the same time, since the back-pressure chamber 57 of the first meter-out valve 20 or that of the second meter-out valve 24 communicates with the pilot tank port passage 25 to bring the poppet 52 to its communication position, the pressure oil discharged from the first pump port passage 11 or the second pump port passage 12 is supplied to the first port passage 14 or the second port passage 15 from which the pressure oil is further supplied to the tank port passage 13.

As shown in FIG. 7, in the first auxiliary meter-in valve 88, an inlet port 101, of a sleeve-like element 100 of the valve 88, is selectively shut off from the first port passage 14 by means of the spool 102. The spool 102 is brought into its shut-off position under the influence of a resilient force exerted by a spring while brought into its communication position under the influence of the pressure oil received in a pressure chamber 103 of the sleeve-like element 100. As shown in FIG. 8, the second auxiliary meter-in valve 98 is similar in construction to the first auxiliary meter-in valve 88 described above.

As shown in FIG. 7, in the first auxiliary pilot valve 87: a spool 105 is inserted into a sleeve-like element 104 so as to selectively shut off an inlet port 106 from an outlet port 107, the spool 105 being driven by means of a solenoid 108; and the inlet port 106 communicates with the first auxiliary pump port passage 81 through a first oil hole 85, while the outlet port 107 communicates with the pressure chamber 103 through a second oil hole 86. When the solenoid 108 is actuated to drive the spool 105 so that the inlet port 106 communicates with the outlet port 107, the pressure oil discharged from a second hydraulic pump (not shown) is supplied to the pressure chamber 103 of the first auxiliary meter-in valve 88 through the first auxiliary pump port passage 81 and the first auxiliary pilot valve 87. As a result, the spool 102 is brought into its communication position to enable the first auxiliary pump port passage 81 to communicate with the first port passage 14 so that the pressure oil discharged from the second hydraulic pump (not shown) is supplied to the first port passage 14.

Incidentally, as shown in FIG. 8, a second auxiliary pilot valve 97 is similar in construction to the first auxiliary meter-in pilot valve 87 described above.

As described above, in the valve housing 10, since there is no valve under the first meter-out valve 20 and the second meter-out valve 24, it is possible to additionally mount a third and a fourth pilot valve on a lower surface 10*e* of the valve housing 10, the third and the fourth valve being employed to separately control the first meter-out valve 20 and the second meter-out valve 24, respectively.

Figure 9:
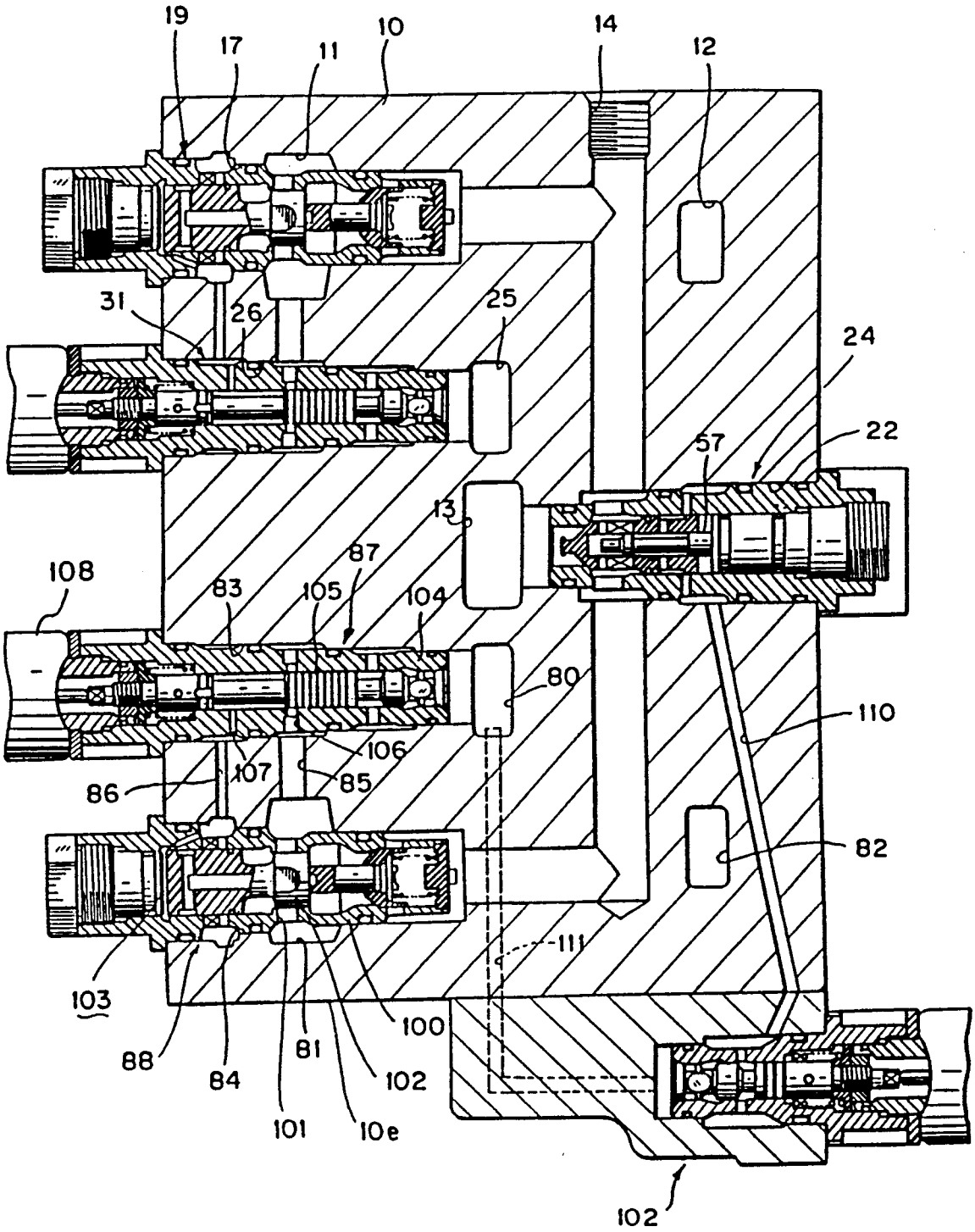
FIGS. 9 and 10 are cross-sectional views of the valve housing of the pilot operated control valve system having the support function of the present invention, illustrating the meter-in valves, the meter-out valves and the pilot valves in construction for separately controlling the second meter-in valve and the second meter-out valve.

For example, as shown in FIG. 9, in the valve housing 10: an oil hole 110 is so formed as to extend from the lower surface 10*e* of the valve housing 10 to the second meter-out valve 22; another oil hole 111 is so formed as to extend from the lower surface 10*e* of the valve housing 10 to the auxiliary pilot tank port passage 80; a solenoid-operated fourth pilot valve 102, for selectively shutting off the oil hole 110 from the oil hole 111, is provided so as to cause the back-pressure chamber 57 of the second meter-out valve 24 to selectively communicate with the auxiliary pilot tank port passage 80, whereby the second meter-out valve 24 is separately controlled.

Figure 10:
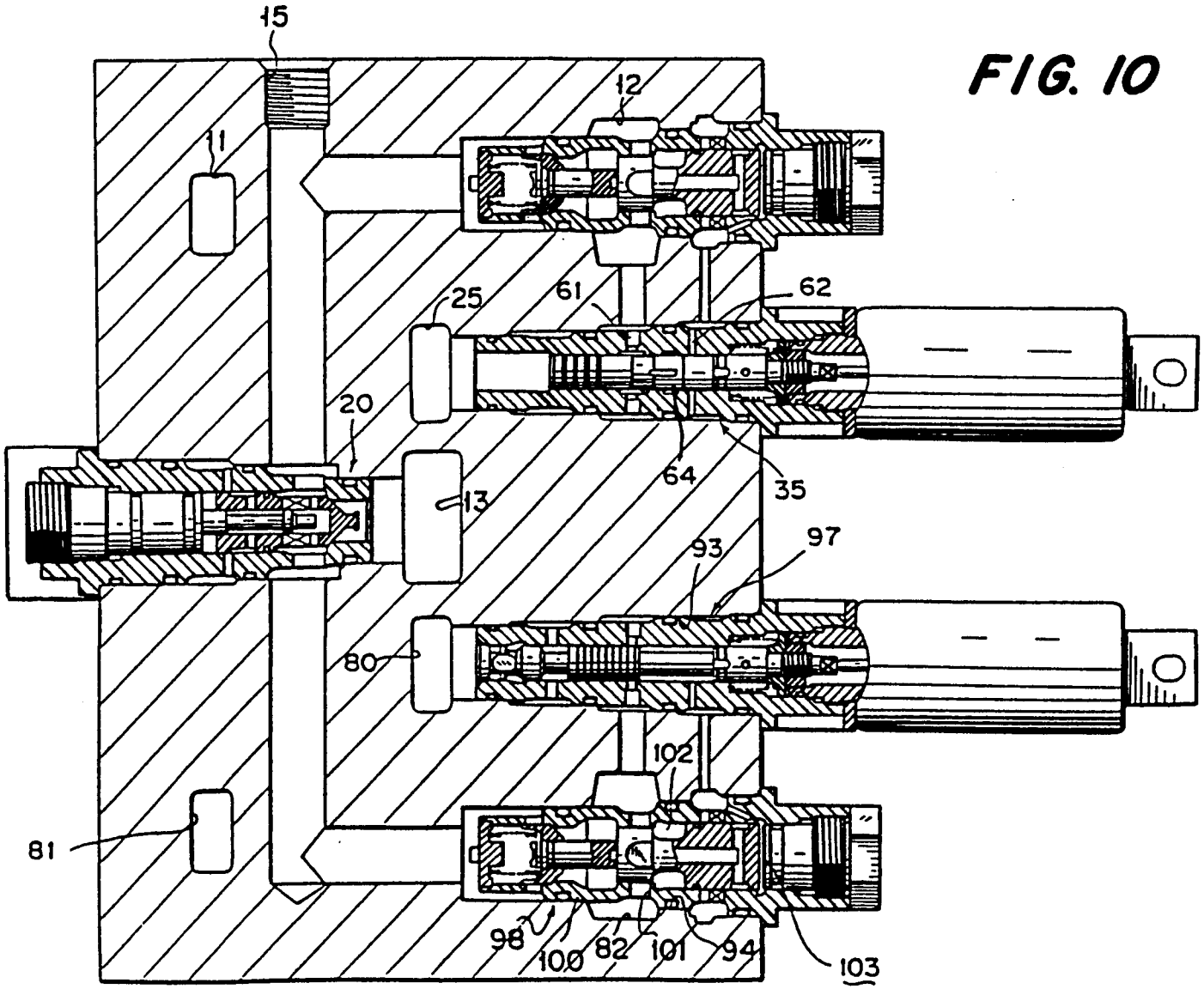

Incidentally, in this case, as shown in FIG. 10, the second pilot valve 35 may have a construction provided with a spool 64 only, the spool 64 being employed to selectively shut off the inlet port 61 from the outlet port 62.

In addition, as is in the case of the above, in instances where another pilot valve (not shown), for separately controlling the first meter-in valve 20, is additionally mounted in a position under the first meter-out valve 20 in the valve housing 10, it is possible to separately control the first meter-in valve 20 in operation.

What is claimed is:

1. A pilot operated control valve system having a support function, comprising: a valve housing which is provided with a predetermined lateral width, a predetermined longitudinal width and a predetermined height, and assumes a substantially rectangular parallelepiped form; a first and a second pump port passage so formed in an upper portion of said valve housing as to have the same height, to be spaced apart in parallel from each other in said longitudinal width direction of said valve housing and to horizontally extend in said lateral width direction of said valve housing; a tank port passage so formed in said valve housing as to be disposed in a central position of both of said height direction and said longitudinal width direction of said valve housing and to horizontally extend in said lateral width direction of said valve housing; a pilot tank port passage and an auxiliary pilot tank port passage so formed in said valve housing as to vertically sandwich said tank port passage therebetween and to extend in parallel with said tank port passage in said lateral width direction of said valve housing so as to be adjacent to said tank port passage; a first and a second pump port passage so formed in a lower portion of said valve housing as to have the same height, to be spaced apart in parallel from each other in said longitudinal width direction of said valve housing and to horizontally extend in said lateral width direction of said valve housing; a first and a second port passage so formed in said valve housing as not to be aligned with each other in either said lateral width direction or said longitudinal width direction of said valve housing, to extend vertically to open into an upper surface of said valve housing and to communicate with at least a pair of hydraulic devices; a first meter-in valve so inserted into a first meter-in valve receiving bore as to selectively shut off said first pump port passage from said first port passage in operation, said first meter-in valve receiving bore being formed in an upper portion of said valve housing so as to open into a side surface of said valve housing perpendicular to said longitudinal width direction thereof, to horizontally extend in said longitudinal width direction to penetrate said first pump port passage and to communicate with said first port passage; a first meter-out valve so inserted into a first meter-out valve receiving bore as to selectively shut off said tank port passage from said second port passage, said first meter-out valve receiving bore being formed in a central portion of said valve housing so as to open into said side surface of said valve housing perpendicular to said longitudinal width direction thereof, to horizontally extend in said longitudinal width direction to sequentially communicate with said second port passage and said tank port passage; a second meter-in valve so inserted into a second meter-in valve receiving bore as to selectively shut off said second pump port passage from said second port passage in operation, said second meter-in valve receiving bore being formed in the upper portion of said valve housing so as to open into the other side surface of said valve housing perpendicular to said longitudinal width direction thereof, to horizontally extend in said longitudinal width direction to penetrate said second pump port passage and to communicate with said second port passage; a second meter-out valve so inserted into a second meter-out valve receiving bore as to selectively shut off said tank port passage from said first port passage, said second meter-out valve receiving bore being formed in a central portion of said valve housing so as to open into the other side surface of said valve housing perpendicular to said longitudinal width direction thereof, to horizontally extend in said longitudinal width direction to sequentially communicate with said first port passage and said tank port passage; a first pilot valve so inserted into a first pilot valve receiving bore as to supply pilot pressure oil to at least one of said first meter-in valve and said first meter-out valve, said first pilot valve receiving bore being so formed in said valve housing at the same height as that of said pilot tank port passage as to horizontally extend in said longitudinal direction of said valve housing to open into the side surface of said valve housing and to communicate with said pilot tank port passage; a second pilot valve so inserted into a second pilot valve receiving bore of said valve housing as to supply said pilot pressure oil to both of said second meter-in valve and said second meter-out valve, said second pilot valve receiving bore being so formed in said valve housing at the same height as that of said pilot tank port passage as to open into the other side surface of said valve housing perpendicular to said longitudinal width direction of said valve housing, to horizontally extend in said longitudinal width direction of said valve housing and to communicate with said pilot tank port passage; a first auxiliary meter-in valve so inserted into a first auxiliary meter-in valve receiving bore of said valve housing as to selectively shut off said first port passage from said first auxiliary pump port passage, said first auxiliary meter-in valve receiving bore being formed in a lower portion of said valve housing so as to open into said side surface of said valve housing perpendicular to said longitudinal width direction of said valve housing, to horizontally extend in said longitudinal width direction of said valve housing, to penetrate said first auxiliary pump port passage and to communicate with said first port passage; a second auxiliary meter-in valve so inserted into a second auxiliary meter-in valve receiving bore of said valve housing as to selectively shut off said second port passage from said second auxiliary pump port passage, said second auxiliary meter-in valve receiving bore being formed in a lower portion of said valve housing so as to open into said other side surface of said valve housing perpendicular to said longitudinal width direction of said valve housing, to horizontally extend in said longitudinal width direction of said valve housing, to penetrate said second auxiliary pump port passage and to communicate with said second port passage; a first auxiliary pilot valve so inserted into a first auxiliary pilot valve receiving bore of said valve housing as to supply said pilot pressure oil to said first auxiliary meter-in valve, said first auxiliary pilot valve receiving bore being formed in a lower portion of said valve housing so as to open into the side surface of said valve housing perpendicular to said longitudinal width direction of said valve housing in the vicinity of said first auxiliary meter-in valve receiving bore and to horizontally extend in said longitudinal width direction of said valve housing; and a second auxiliary pilot valve so inserted into a second auxiliary pilot valve receiving bore of said valve housing as to supply the pilot pressure oil to said second auxiliary meter-in valve, said second auxiliary pilot valve receiving bore being formed in an upper portion of said valve housing so as to open into said other side surface of said valve housing perpendicular to said longitudinal width direction of said valve housing in the vicinity of said second auxiliary meter-in valve receiving bore and to horizontally extend in said longitudinal width direction of said valve housing.

2. The pilot operated control valve system having the support function as set forth in claim 1, wherein in order to separately control said first meter-in valve and said first meter-out valve from each other, said first pilot valve is dedicated to said first meter-in valve in operation; and said pilot operated control valve system further comprises a third pilot valve dedicated to said first meter-out valve in operation.

3. The pilot operated control valve system having the support function as set forth in claim 1, wherein in order to separately control said second meter-in valve and said second meter-out valve from each other, said second pilot valve is dedicated to said second meter-in valve; and said pilot operated control valve system further comprises a fourth pilot valve dedicated to said second meter-out valve.

4. The pilot operated control valve system having the support function as set forth in claim 1, wherein said pilot operated control valve system having the support function is constructed of a plurality of control valve units for controlling a plurality of hydraulic equipments, said plurality of said control valve units being connected with each other in said lateral width direction of said valve housing of said pilot operated control valve system having the support function.

* * * * *